US006786746B2

(12) United States Patent
Nagamine et al.

(10) Patent No.: US 6,786,746 B2
(45) Date of Patent: Sep. 7, 2004

(54) SQUIB CONNECTOR ASSEMBLY

(75) Inventors: Akira Nagamine, Aichi (JP); Takashi Iida, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 342 days.

(21) Appl. No.: 10/102,357

(22) Filed: Mar. 20, 2002

(65) Prior Publication Data

US 2002/0154494 A1 Oct. 24, 2002

(30) Foreign Application Priority Data

Apr. 20, 2001 (JP) ..... 2001-121888

(51) Int. Cl.[7] ..... H01R 29/00
(52) U.S. Cl. ..... 439/188; 439/620
(58) Field of Search ..... 439/188, 620, 439/510

(56) References Cited

U.S. PATENT DOCUMENTS 5,275,575 A 1/1994 Cahaly et al. ..... 439/188
5,580,260 A * 12/1996 Flieger et al. ..... 439/188
5,647,757 A * 7/1997 Chrysostomou ..... 439/352
6,203,342 B1 3/2001 Gauker et al. ..... 439/188
6,217,388 B1 * 4/2001 Francis ..... 439/620
6,547,596 B1 * 4/2003 Pavlovic et al. ..... 439/620
6,623,275 B1 * 9/2003 Pavlovic et al. ..... 439/38

FOREIGN PATENT DOCUMENTS

JP 2647336 5/1997

* cited by examiner

*Primary Examiner*—Gary Paumen
(74) *Attorney, Agent, or Firm*—Osha & May L.L.P.

(57) ABSTRACT

A squib connector assembly for energizing a gas producer to make it ignite, the squib connector assembly comprising a first component for supporting a male electrical connector element; a second component for supporting a female electrical connector element engageable with the male electrical connector element; and a short-circuit element selectively switchable between a short-circuit position to electrically short-circuit the male electrical connector element and a non-short-circuit position. A flat-plate-like noise filter having electromagnetic wave absorbing material is arranged between the first component and the short-circuit element, so as to allow the male electrical connector element to extend through it and surround the male electrical connector element. This can provide the squib connector assembly that can adequately meet the demand for miniaturization and space saving.

4 Claims, 4 Drawing Sheets

SQUIB CONNECTOR ASSEMBLY

BACKGROUND OF THE INVENTION

1. Technical Field of the Invention

The present invention relates to a connector assembly for interconnecting end portions of electric cables. More particularly, the present invention relates to a squib connector assembly and a component thereof, used in an airbag system for restraining vehicle occupants, for electrically energizing a gas producer to make it ignite.

2. Description of the Prior Art

An airbag system comprises an airbag assembly and an electric or electronic control system which are assembled in a hidden compartment of a driver's cabin of a vehicle. The control system is connected with the airbag assembly via a wire harness. Typically, the wire harness is provided with a connector assembly comprising electrical plug and jack, to allow a simple way for the airbag assembly and the control system to be electrically interconnected after assembled separately.

A typical electrical connection of a conventional airbag system is schematically illustrated in FIG. 4. In FIG. 4, a control system 100 is connected with a squib (igniter) 101 through the lines 102. The squib 101 is loaded in an airbag assembly, not shown, to electrically energize the gas producer to make it ignite, so as to inflate the airbag in the airbag assembly. This connection is provided by a squib connector assembly 103 comprising a first component 104 and a second component 105. Some examples of the squib connector assembly used in the airbag system are disclosed by U.S. Pat. No. 5,275,575 and JP Patent No. 2647336, for example.

In the squib connector assembly 103, a short-circuit element 107 is attached to the first component 104 so as to bridge between a pair of lines continuing into the squib 101, so as to provide short circulation. Also, a ferrite bead 106 is attached to the second component 105, allowing the lines 102 to extend therethrough. This construction is disclosed by JP Patent No. 2647336 as previously cited as well. The short-circuit element 107 is arranged as a safety device to prevent improper operation of the airbag assembly caused by leakage of electrical charge or improper connection in the course of production. The short-circuit element 107 is constructed to selectively switch between a short-circuit position and a non-short-circuit position. The ferrite bead 106 serves to provide the noise filtering function to prevent passage of noise current into the squib 101 that is caused by various kinds of electromagnetic waves from external equipment, including electric cables, various kinds of electronic equipment in the vehicle, a radio and a mobile phone, in order to prevent an explosion accident in the airbag system built in the vehicle. In the squib connector assembly, the ferrite bead 106 used as the noise filtering means is usually arranged on the second component 105. As an alternative to the ferrite bead in the squib connector assembly, coiled lines 102 may be used as the noise filtering means.

It will be understood from FIG. 4, however, that the conventional squib connector assembly requires a certain degree of lengthwise dimension to fully filter out noises by means of the ferrite bead or coiled lines. Due to this, the size of the ferrite bead itself or equivalent is becoming a limiting factor of miniaturization of the squib connector assembly which is recently being increasingly demanded for space saving provided by the miniaturization. In addition, the conventional squib connector assembly inevitably involves a complex assembling work that the wiring is made to pass through two narrow elongated thru holes in the ferrite bead, thus leading to reduction in workability.

SUMMARY OF THE INVENTION

It is the object of the present invention to provide a squib connector assembly and a component thereof that can adequately meet the demand for miniaturization and space saving and can provide improved workability in the assembling work.

In accordance with one aspect of the invention, there is provided a squib connector assembly for energizing a gas producer to make it ignite, the squib connector assembly comprising a first component for supporting a male electrical connector element; a second component for supporting a female electrical connector element engageable with the male electrical connector element; and a short-circuit element selectively switchable between a short-circuit position to electrically short-circuit the male electrical connector element and a non-short-circuit position, wherein a flat-plate-like noise filter having electromagnetic wave absorbing material is arranged between the first component and the short-circuit element, so as to allow the male electrical connector element to extend through it and surround the male electrical connector element.

According to this construction, the use of the flat-plate-like noise filter having electromagnetic wave absorbing material permits the full performance of capacitance function, and as such can permit the noise filtering function not inferior to that of the conventional squib connector assembly using the ferrite bead. Thus, the use of the thin and easily attachable noise filter can provide the squib connector assembly that can adequately meet the demand for miniaturization and space saving and provide improved workability in the assembling work. It should be noted that the capacitance function noted above indicates the function to absorb and filter out high-frequency noise current in the same manner as in the condenser.

In accordance with another aspect of the invention, there is provided a component used in a squib connector assembly for energizing a gas producer to make it ignite, the squib connector assembly comprising a first component for supporting a male electrical connector element; a second component for supporting a female electrical connector element engageable with the male electrical connector element; and a short-circuit element selectively switchable between a short-circuit position to electrically short-circuit the male electrical connector element and a non-short-circuit position, wherein the component used in the squib connector assembly comprises the short-circuit element to which a flat-plate-like noise filter having electromagnetic wave absorbing material is attached and provides a noise filtering function for the male electrical connector element by attaching the short-circuit element to the first component. This component of the squib connector assembly is specifically used for a squib connector assembly for energizing a gas producer to make it ignite.

According to this construction, the use of the flat-plate-like noise filter having electromagnetic wave absorbing material permits the full performance of capacitance function, and as such can permit the noise filtering function not inferior to that of the conventional squib connector assembly using the ferrite bead. Thus, the use of the thin and easily attachable noise filter can provide the component of the squib connector assembly that can adequately meet the demand for miniaturization and space saving and provide improved workability in the assembling work.

These and other objects, features and advantages of the invention will become more apparent upon a reading of the following detailed specification with reference to the accompanying drawings.

DETAILED DESCRIPTION OF THE PREFERRED EMBODIMENTS

Figure 1:
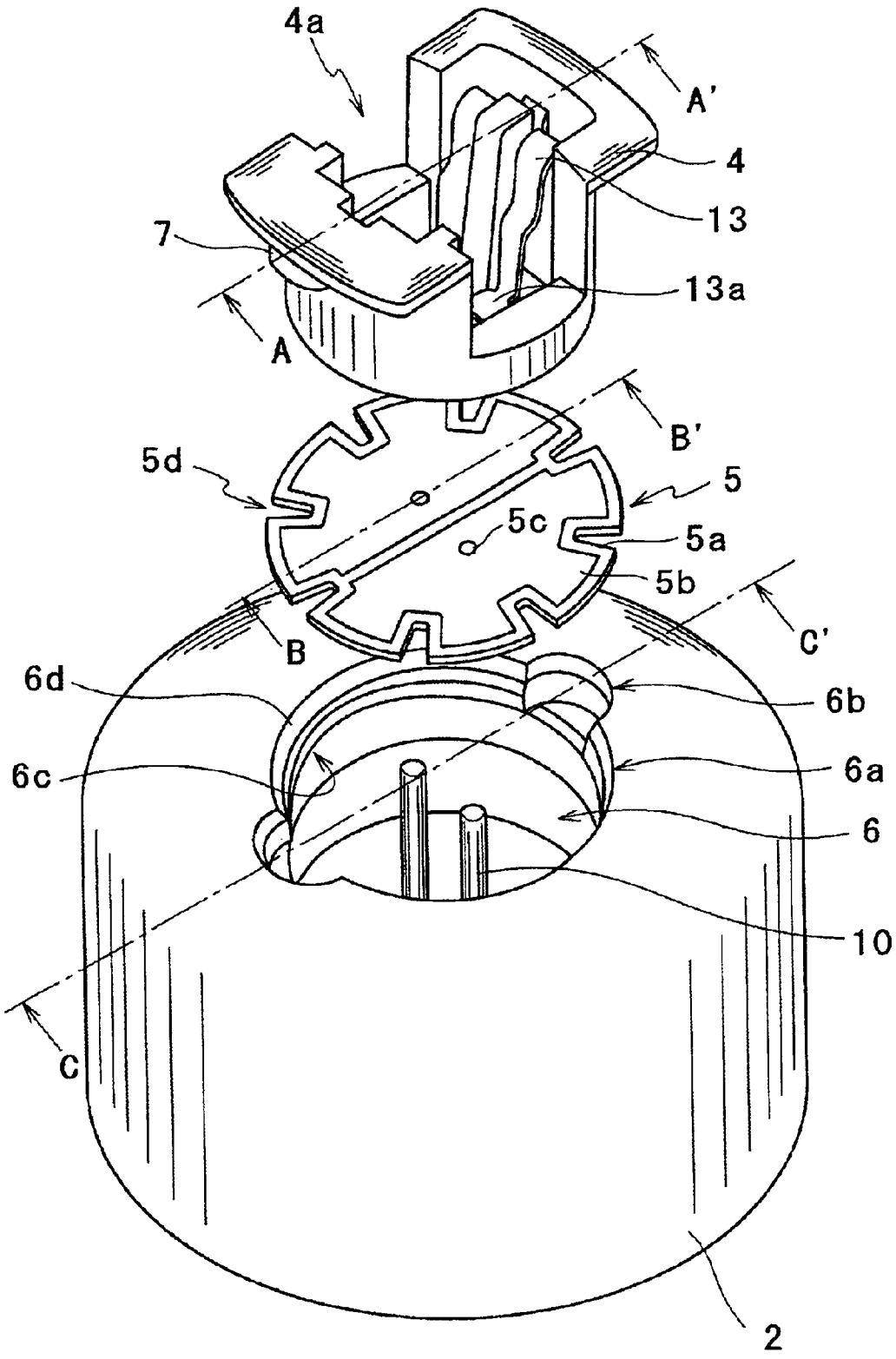
FIG. 1 is an exploded perspective view showing the components of a squib connector assembly according to the present invention.
Figure 2:
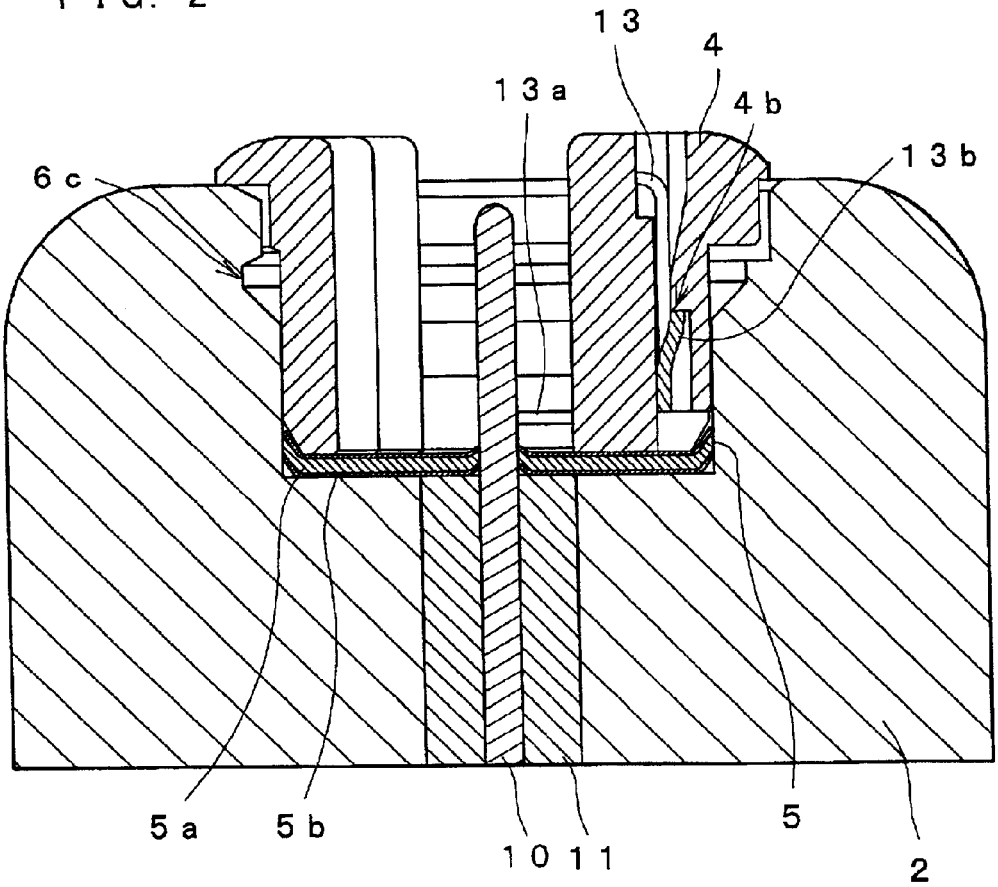
FIG. 2 is a sectional view showing the components built in the squib connector assembly shown in FIG. 1 taken along line indicated by arrows.
Figure 3:
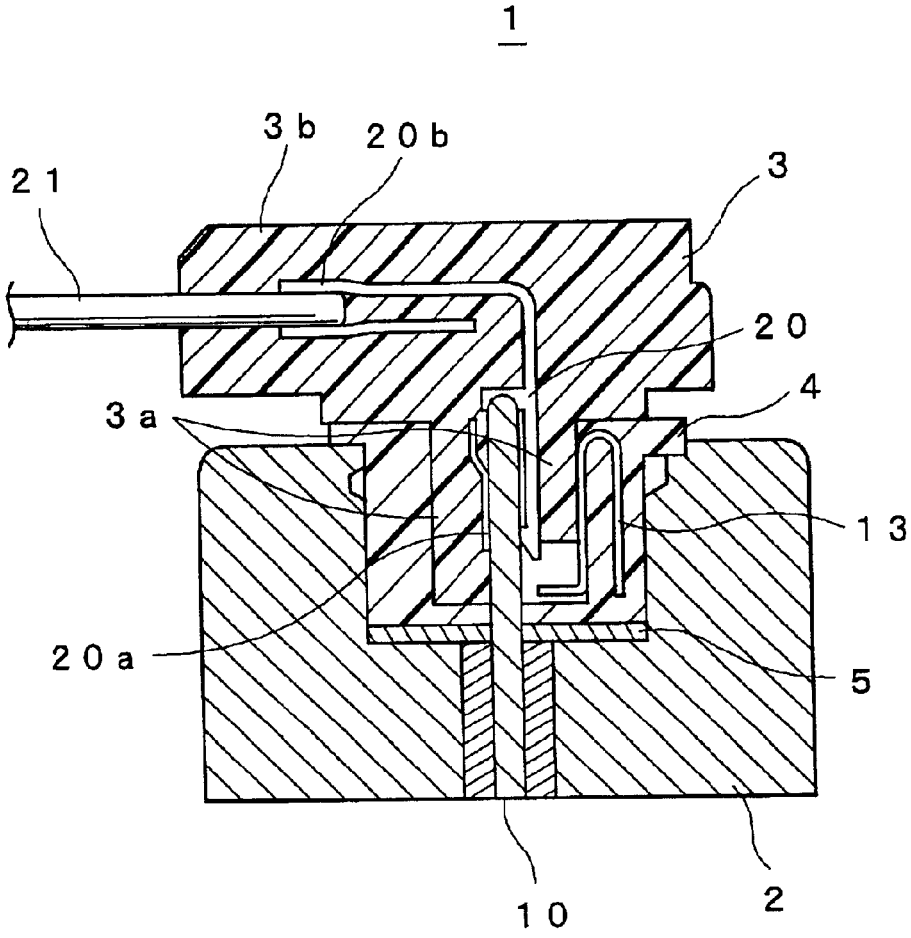
FIG. 3 is a sectional view of the squib connector assembly according to the present invention which is in the state in which the first component and the second component are in engagement with each other.
Figure 4:
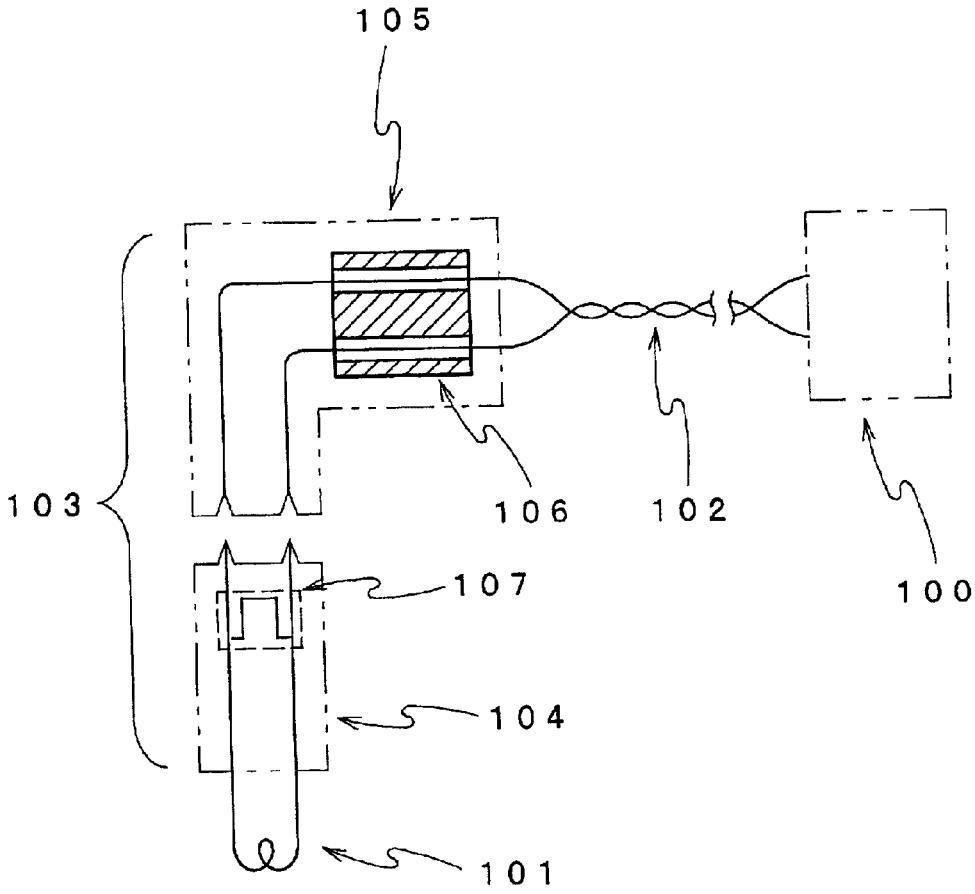
FIG. 4 is a schematic illustration of a typical electrical connection of a conventional airbag system.

In the following, a certain preferred embodiment of the present invention will be described with reference to the accompanying drawings. Shown in FIG. 3 is a sectional view of a squib connector assembly 1 according to the illustrated embodiment which is in the state in which a first component 2 and a second component 3 are in engagement with each other. Shown in FIG. 1 is an exploded perspective view showing the components of the squib connector assembly 1. Shown in FIG. 2 is a sectional view showing the components built in the squib connector assembly 1 shown in FIG. 1 taken along line indicated by arrows.

As shown in FIG. 3, the squib connector assembly 1 according to the illustrated embodiment has the first component 2 for supporting a male electrical connector element 10, the second component 3 for supporting a female electrical connector element 20 engageable with the male electrical connector element 10, a short-circuit element 4 selectively switchable between a short-circuit position to electrically short-circuit the male electrical connector element 10 and a non-short-circuit position, and a flat-plate-like noise filter 5.

In FIG. 3, the first component 2 and the second component 3 are put in engagement with each other, whereby a connection between the female electrical connector element 20 connected to one end of a cable 21 and the male electrical connector element 10 is provided. This permits an electrical conduction state of an airbag control system (not shown) connected to the other end of the cable 21 and a squib (igniter) for electrically energizing a gas producer for inflating the airbag through the male electrical connector element 10 to make the gas producer ignite. In this state, if a specified current is passed into the squib through the cable 21 under commands issued from the control system, the gas producer will be ignited by the squib and thereby the airbag will be inflated.

Further, the construction of the squib connector assembly 1 according to the illustrated embodiment will be described in detail with respect to each individual component.

Referring first to the first component 2 forming a part of the squib, it has a bottom portion of a generally cylindrical shape, as shown in FIG. 1, and is incorporated in a part of a container of the gas producer not shown. The first component 2 has an opening at the top and has a socket 6 in the interior thereof. The socket 6 has, at its opening portion 6*a*, semicircular concave portions 6*b* engageable with projecting portions 7 (mentioned later) of the short-circuit element 4 to position the short-circuit element 4 in place. The socket 6 also has, in its opening portion 6*a*, a retaining groove 6*c* continuously extending around the opening portion 6*a* to retain an elastic leg (not shown) of the second component 3 when the second component 3 is engaged in the opening portion 6*a*. In addition, the socket 6 has, at its opening portion 6*a*, a slant surface 6*d* that allows the elastic leg to be deflected inwardly when the second component 3 is fittingly inserted into the socket 6. A pair of pin type male electrical connector elements 10, which comprises conductor metal exposed from a bottom portion of the first component 2, are extended into the socket 6.

In FIG. 2, there is shown the sectional view of the first component 2 taken along line C–C' indicated by arrows. FIG. 2 shows the state in which a short-circuit element 4 and a noise filter 5 (mentioned later) are incorporated in the first component 2. In FIG. 2, the first component 2 has the male electrical connector elements 10 extending at the center thereof and an insulation portion 11 comprising insulating material surrounding the male electrical connector elements 10. All portions of the first component 2 other than the insulation portion 11 are formed of conductor such as metal. Those conductor portions are put in contact with flat-plate-like conductors 5*b* (mentioned later) mounted on the noise filter 5 and higher in resistance than a heating wire of the squib, so that they are earthed to release the electric energy absorbed in the noise filter 5.

Referring now to the short-circuit element 4, the short-circuit element 4 operates to keep the male electrical connector elements 10 of the first component 2 in the short-circuit state until the first component 2 and the second component 3 are completely engaged with each other. In FIG. 1, the short-circuit element 4 is formed to have a generally cylindrical shape having an outside dimension to tightly fit in the socket 6. The short-circuit element 4 is formed by insulating material such as plastic. The short-circuit element 4 is provided, at its sides on the top, with semi-columnar projecting portions 7 that are extended short downwardly therefrom so as to correspond in location and size to the concave portions 6*b* as previously noted so that they can be snugly received in the concave portions 6*b*. Those projecting portions 7 and concave portions 6*b* serve to set the short-circuit element 4 in position, as previously mentioned. Further, the short-circuit element 4 has an opening 4*a* into which the male electrical connector elements 10 are extended passing through the bottom. The opening 4*a* is formed to open to the top at the center portion of the short-circuit element 4 and to both lateral sides thereof, as illustrated. Also, the short-circuit element 4 holds a short-circuit clip 13 having a pair of legs 13*a* in it. The short-circuit clip 13 is formed of conductive material having elasticity such as spring steel, and the front ends 13*a* of the legs are deflected in the direction of their abutting with the male electrical connector elements 10. This abutment of the legs 13*a* of the short-circuit clip 13 with the male electrical elements 10 provides an electrical short circuit therebetween.

As seen from FIG. 2 showing the sectional view of the short-circuit element 4 taken along line A–A' indicated by arrows, the short-circuit clip 13 is in abutment with the male electrical connector elements 10 at its legs 13*a* before the first component 2 and the second component 3 are put into engagement with each other. Then, when the second component 3 is fittingly inserted in the first component 2 to engage with it, the short circulation is released by a plug portion 3*a* of the second component 3, as shown in FIG. 3. The short-circuit clip 13 has portions 13*b* to bridge between the pair of legs 13*a*. The portion 13*b* of the short-circuit clip 13 is partly bent in the opposite direction to the legs 13*a*, so as to be held by stepped portion 4*b* of the short-circuit element 4 that is partly formed around an inside wall of the short-circuit element 4, as shown in FIG. 2.

In FIGS. 1–3, the noise filter 5 is arranged between the first component 2 and the short-circuit element 4. The noise filter 5 includes (i) a basal plate 5*a* comprising electromagnetic wave absorbing material and having front and back surfaces which are parallel with each other and (ii) flat-plate-like, high-resistance, conductors 5*b* mounted on the front and back surfaces of the basal plate 5*a*, respectively. The flat-plate-like conductors 5*b* are each formed in generally semicircular shape and are separately mounted two on each of the front and back surfaces of the basal plate, as shown in FIG. 1. Also, these conductors 5*b* on the front and back surfaces of the basal plate are arranged to be overlaid in parallel with each other. The noise filter 5 has two thru holes 5*c* to allow the male electrical connector elements 10 to extend through their respective conductors 5*b*. FIG. 2 showing the sectional view taken along line B–B' indicated by arrows and FIG. 3 showing the sectional view show the male electrical connector elements 10 which are in the state of extending through the thru holes 5*c*.

As shown in FIG. 1, the noise filter 5 has a plurality of indentations 5*d* formed around its periphery. The indentations 5*d* serve to bend an end portion of the noise filter 5 when the noise filter 5 is inserted in the socket 6, so as to allow the end portion of the noise filter 5 to closely contact with an inner bottom of the socket 6 therealong, as shown in FIG. 2.

Preferably, the electromagnetic wave absorbing materials of the basal plate 5*a* used include soft magnetic material or high dielectric loss material. The use of these materials can surely provide the capacitance function for the basal plate 5*a*. The soft magnetic materials that may be used include, for example, metals and metal oxides such as ferrite. The high dielectric loss materials that may be used include, for example, resins such as polytetrafluoroethylene, ceramics such as alumina, barium titanate ($TiBa_3$), and silicon rubbers. The basal plates used include those formed into a variety of forms by supporting soft magnetic metal or metal oxide or ceramic powder on binder such as resin and rubber.

Referring finally to the second component 3, the second component 3 in FIG. 3 includes a plug portion 3*a* engageable with the first component 2 and a body portion 3*b* bent in a generally L-form with respect to the plug portion 3*a*. The female electrical connector element 20 having tubular terminals 20*a* and 20*b* at both ends thereof is built in the second component 3. The terminals 20*a* and 20*b* are arranged in a generally L-form so that the terminals 20*a* at one end of the female electrical connector element 20 can be located in the plug portion 3*a* of the second component 3 and the terminals 20*b* at the other end thereof can be located in the body portion 3*b* of the second component 3. When the first component 2 and the second component 3 are engaged with each other, the male electrical connector elements 10 are inserted in the tubular terminals 20*a* to be contacted with the inner walls of the terminals 20*a*, so as to be electrically connected with them. A cable 21 is inserted in the tubular terminal 20*b*.

The squib connector assembly 1 according to the illustrated embodiment is constructed as mentioned above. Thus, in the illustrated embodiment, the flat-plate-like noise filter 5 arranged between the first component 2 and the short-circuit element 4 is used as means for performing its function of filtering out noises to prevent the explosion accident of the airbag. Hence, there is no need to use the elongate noise filtering means, such as a long ferrite bead, used in the conventional squib connector assembly and, as a result, a considerable miniaturization of the second component 3 can be achieved.

Next, the assembling method of the squib connector assembly 1 having the features mentioned above will be described. The noise filter 5 is first inserted in the socket 6 built in the first component 2 of a part of the squib. At this time, the noise filter 5 is oriented to allow the pair of male electrical connector elements 10 to fit into the thru holes 5*c*. Then, the short-circuit element 4 is inserted in the socket 6 to sandwich the noise filter 5 therebetween, in accordance with the assembling order shown in FIG. 1. At this time, the positional relation between the first component 2 and the short-circuit element 4 is determined by fitting the projecting portions 7 of the short-circuit element 4 in the concave portions 6*b*.

FIG. 2 shows the sectional view of the assembly of the noise filter 5 and the short-circuit element 4 fittingly inserted in the socket 6. In this assembled state, the pair of legs 13*a* of the short-circuit clip 13 are in abutment with the pair of male electrical connector elements 10 to form the electrical short circuit therebetween. The assembling work of the airbag is usually performed while the short circuit is kept formed. This serves as a safety device to prevent improper operation of the airbag assembly caused by leakage of electrical charge or improper connection in the course of production.

Then, the second component 3 is fittingly inserted in the opening 4*a* of the short-circuit element 4 and the socket 6, as shown in the sectional view of FIG. 3. This leads to insertion of the male electrical connector elements 10 in the tubular terminals 20*a* of the female electrical connector elements 20 to be contacted with the inner wall of the terminal 20*a*. As a result of this, the airbag assembly and control system (not shown) are electrically connected with each other and thereby the airbag system is completely constructed. The engagement between the first component 2 and the second component 3 is held by the elastic legs (not shown) of the second component 3 being engaged in the retaining groove 6*c*. Then, along with the fitting insertion of the second component 3, the plug portion 3*a* of the second component 3 is inserted in the space between the legs 13*a* of the short-circuit clip 13 and the male electrical connector elements 10 to deflect the legs 13*a* of the short-circuit clip 13 and thereby the short circuit is released.

In this state, if a specified current is passed into the squib connector assembly 1 thus assembled through the cable 21 under commands issued from the control system, the squib will be energized through the male electrical connector elements 10 and ignited to inflate the airbag. Reference is now given to the noise filtering function of the squib connector assembly 1 which is in this state.

In the airbag system loaded in the vehicle, there is the possibility that the noise current could be passed into the squib by various kinds of high-frequency electromagnetic waves from external equipment, including electric cables, various kinds of electronic equipment in the vehicle, a radio and a mobile phone, as mentioned above. The flat-plate-like noise filter 5 absorbs the electromagnetic waves and thereby it carries out its noise filtering function to prevent the explosion accident caused by the noise current being passed into the squib. In other words, the flat-plate-like noise filter 5, which comprises the basal plate 5*a* comprising electromagnetic wave absorbing material and the conductors 5*b* formed to hold the basal plate 5*a* in a sandwich relation from both sides, has the capacitance function as the condenser to absorb high-frequency noises. Also, the conductors 5*b* are earthed by putting them into contact with the conductor portions of the first component 2, as shown in FIG. 2, whereby the electric energy absorbed in the noise filter 5 is released to outside. Thus, the squib connector assembly 1 can perform its noise filtering function to prevent the explosion accident of the airbag.

This construction that the conductor portions of the first component 2 are earthed by partly contacting them with the noise filter 5 can provide the squib connector assembly that can surely perform its noise filtering function, even when downsized.

Further, according to the noise filter 5 according to the illustrated embodiment, since the noise filter 5 is arranged to surround the male electrical connector elements 10, it can perform its induction function as well as its capacitance function. This can provide the advantage that the noise filter 5 according to the illustrated embodiment has the function to filter out low-frequency noises as well.

As described above, according to the squib connector assembly 1 according to the illustrated embodiment, the use of the flat-plate-like noise filter having electromagnetic wave absorbing material permits the full performance of capacitance function, and as such can permit the noise filtering function not inferior to that of the conventional squib connector assembly using the ferrite bead. Thus, the use of the thin and easily attachable noise filter can provide the squib connector assembly that can adequately meet the demand for miniaturization and space saving and provide improved workability in the assembling work.

The description on the illustrated embodiment above is applied to the components of the squib connector assembly according to the present invention.

The present invention should not be limited to the embodiment illustrated above and various changes and modifications may be made in the invention within the scope of the claims. To cite instances:

(1) The noise filter may be the one integrally attachable to the short-circuit element, rather than the one separately formed to be arranged in between the first component and the short-circuit element as in the illustrated embodiment. In this alteration, the noise filter may be formed to be attached to the first component at the same time that the short-circuit element is attached to the first component. In this modification, the noise filter may be integrally attached to the short-circuit element in any adequate methods including adhesive bonding, caulking and electrodeposition.

According to this construction, since the noise filter is integrally attached to the short-circuit element, the squib connector assembly that can provide further improved workability of the assembling work can be obtained.

(2) The indentations formed around the noise filter may be formed into any shape, without limiting to those shown in the illustrated embodiment. Also, the indentations are not indispensable.

(3) The conductors arranged on each side of the basal plate of the noise filter may be formed to have any suitable shape and size for the noises to be filtered out, without limiting to the generally semicircle shape as shown in the illustrated embodiment.

(4) The conductor portions of the first component may be formed to have any shape, without limiting to the shape as shown in the illustrated embodiment, as long as they further surround the insulating material surrounding the male electrical connector elements to contact with the conductors of the noise filters, so as to provide the grounding function.

What is claimed is:

1. A squib connector assembly for energizing a gas producer to make it ignite, the squib connector assembly comprising:

a first component for supporting a male electrical connector element;

a second component for supporting a female electrical connector element engageable with the male electrical connector element; and a short-circuit element selectively switchable between a short-circuit position to electrically short-circuit the male electrical connector element and a non-short-circuit position, wherein a flat-plate-like noise filter having electromagnetic wave absorbing material is arranged between the first component and the short-circuit element, so as to allow the male electrical connector element to extend through it and surround the male electrical connector element.

2. The squib connector assembly according to claim 1, wherein the first component includes a conductor portion comprising an electric conductor, and the conductor portion is partly contacted with the noise filter to conduct and is earthed.

3. The squib connector assembly according to claim 1, wherein the noise filter is integrally attached to the short-circuit element.

4. A component used in a squib connector assembly for energizing a gas producer to make it ignite, the squib connector assembly comprising a first component for supporting a male electrical connector element; a second component for supporting a female electrical connector element engageable with the male electrical connector element; and a short-circuit element selectively switchable between a short-circuit position to electrically short-circuit the male electrical connector element and a non-short-circuit position, wherein the component used in the squib connector assembly comprises the short-circuit element to which a flat-plate-like noise filter having electromagnetic wave absorbing material is attached and provides a noise filtering function for the male electrical connector element by attaching the short-circuit element to the first component.

* * * * *